United States Patent [19]

Alirot et al.

[11] 4,199,709

[45] Apr. 22, 1980

[54] INJECTION OF AN ELECTRON BEAM

[75] Inventors: Jean-Louis Alirot, Chamalieres; René Le Gardeur, Grenoble, both of France

[73] Assignee: Commissariat a l'Energie Atomique, Paris, France

[21] Appl. No.: 918,369

[22] Filed: Jun. 23, 1978

[30] Foreign Application Priority Data

Jun. 27, 1977 [FR] France ..... 77 19620

[51] Int. Cl.[2] ..... H01J 25/00

[52] U.S. Cl. ..... 315/4; 315/3; 315/5; 315/5.31; 315/5.39

[58] Field of Search ..... 315/5.34, 5.35, 5.31, 315/4, 3, 5, 3.5, 5.39

[56] References Cited

U.S. PATENT DOCUMENTS

| | | | |
|---|---|---|---|
| 2,812,467 | 11/1957 | Kompfner | 315/3.5 |
| 2,843,776 | 7/1958 | Tien | 315/3.6 X |
| 2,857,548 | 10/1958 | Kompfner et al. | 315/3.5 |
| 2,999,959 | 9/1961 | Kluver | 315/3.6 |
| 3,072,817 | 1/1963 | Gordon | 315/3 |
| 3,102,211 | 8/1963 | Sturrock | 315/5.31 X |
| 3,183,399 | 5/1965 | Pantell | 315/5.31 X |
| 3,316,439 | 4/1967 | Kluver | 315/3 X |

*Primary Examiner*—Saxfield Chatmon, Jr.

[57] ABSTRACT

Injector for an annular beam of monokinetic electrons in helical orbits having a high inclination angle relative to the axis of the helix of the type having an annular electron gun in a revolving vacuum enclosure. It comprises electrical coils which are able to create the cyclotron effect by a static magnetic field varying in progressive and continuous manner in accordance with the axis of the injector from a value $B_1$ in the actual gun zone up to a value $B_3$ in the contracted outlet zone of the injector passing through an intermediate value $B_2$ in the convergent connection zone between said gun zone and said outlet zone, and a correcting electrode located so as to be movable in accordance with the axis of the injector and which is raised to an electrical potential differing from that of the suction or extraction anode of said electron gun.

8 Claims, 8 Drawing Figures

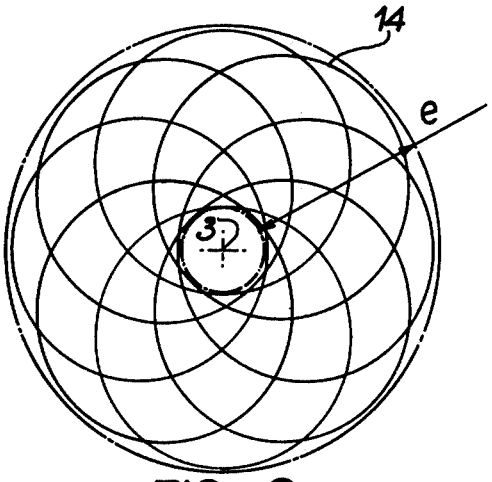
FIG. $2_a$
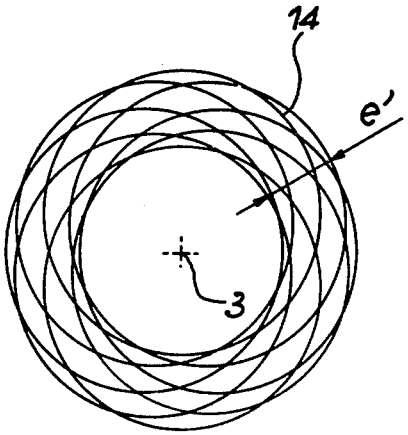
FIG. $2_b$
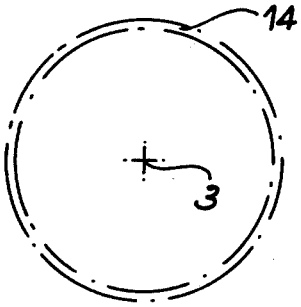
FIG. $2_c$
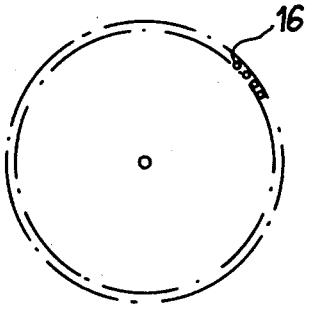
FIG. $4_a$
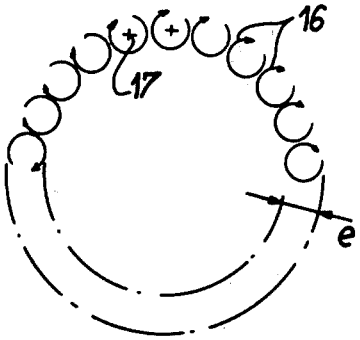
FIG. $4_b$
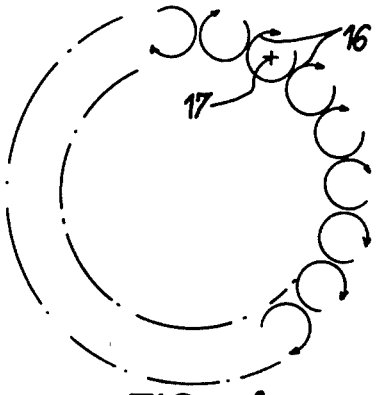
FIG. $4_c$

INJECTION OF AN ELECTRON BEAM

BACKGROUND OF THE INVENTION

The present invention relates to the injection of an electron beam into a resonant cavity or electromagnetic structure.

In known manner in the generation of very high frequency electromagnetic energy the interaction between an electron beam and the electromagnetic field of a resonant cavity or structure is used. More specifically it is known to use for this purpose an annular electron beam which is essentially linked with the azimuth component of the electrical field of an electromagnetic structure or cavity in the resonant mode. In the present text the term annular beam is used to mean any beam whose cross-section is a ring between two concentric circumferences. In this type of energy generating apparatus it is very important to be able to dispose a monokinetic electron beam at the outlet from the injector if it is desired to obtain high yields of hyperfrequency power.

BRIEF SUMMARY OF THE INVENTION

The present invention relates to an injector of a tubular beam of monokinetic electrons in helical orbits of simple construction and which by means of a very simple regulation makes it possible to obtain as required annular beams of monokinetic electrons whose thickness is randomly variable within wide proportions and whereof the inclination angle of the helical trajectories of each electron relative to the axis of the corresponding helix can reach high values.

This injector is of the type having an annular electron gun in a revolving vacuum enclosure, wherein it also comprises electrical coils which are able to create the cyclotron effect by a static magnetic field varying in accordance with the axis of the injector from a value $B_1$ in the actual gun zone up to a value $B_3$ in the contracted outlet zone of the injector passing through an intermediate value $B_2$ in the convergent connection zone between said gun zone and said outlet zone, and a correcting electrode located so as to be movable in accordance with the axis of the injector and which is raised to an electrical potential differing from that of the suction or extraction anode of said electron gun.

According to the invention the correcting electrode located on the axis of the device within the annular electronic beam comprises a conductive mass of electricity having an ovoid shape whose axis of symmetry coincides with that of the injector. By the potential to which it is raised it serves solely to ensure the modification of the configuration of the lines of the electrical field in the injector. It is by varying both the axial position of said electrode and the positive or negative potential to which it is brought relative to the suction anode of the electron beam that it is possible to modify the inclination angle of the helices constituting the various trajectories of the electrons.

According to another very important feature of the invention and which is used at the same time as the above feature, the magnetic fields $B_1$ and $B_3$ (or more precisely their axial component) which are applied respectively in the suction anode region of the electron gun and in the outlet zone of the injector may be of the same or opposite directions and this consequently leads to completely different shapes for the trajectories of the electrons in the annular zone which they fill.

When the fields $B_1$ and $B_3$ (or more precisely their axial component) are of the same direction, each electron describes under the cyclotron effect a special helix, whose axis is parallel to the axis of symmetry of the injector, but is also located in the annular zone covered by the beam. In other words in this case each electron describes a small helix, whose diameter is equal to the annular thickness of the electron beam.

In the embodiment where the axial components of the magnetic fields $B_1$ and $B_3$ are of opposite directions the configuration of the beam differs and each electron describes under the cyclotron effect a helix which in eccentric manner surrounds the axis of the injector. If in this embodiment the beam is regulated by means of the correcting electrode to obtain a minimum annular thickness each electron then describes a special helix, whose axis virtually coincides with the injector axis. Therefore, in this limiting case, each electron describes a helix whose radius is virtually equal to the radius of the tubular beam.

According to the invention a system of coils placed along the outer wall of the vacuum enclosure of the injector is provided to produce at the desired locations the various static magnetic fields $B_1$, $B_2$ and $B_3$, whose axial components vary from the electron gun up to the suction zone at the outlet from the apparatus.

BRIEF DESCRIPTION OF THE DRAWINGS

The invention is described in greater detail hereinafter relative to non-limitative embodiments and with reference to the attached drawings, wherein show:

FIGS. 2*a*, 2*b* and 2*c*: sectional views along the plane XY of FIG. 1, representing three different configurations of the beam just before it enters the electromagnetic structure or cavity located in the interaction region 2.

FIGS. 4*a* 4*b* and 4*c*: three possible configurations of the annular beam obtained in accordance with the sectional plane X'Y' of FIG. 3 in the vicinity of its entry into the interaction region 2.

DETAILED DESCRIPTION OF THE PREFERRED EMBODIMENTS

Figure 1:
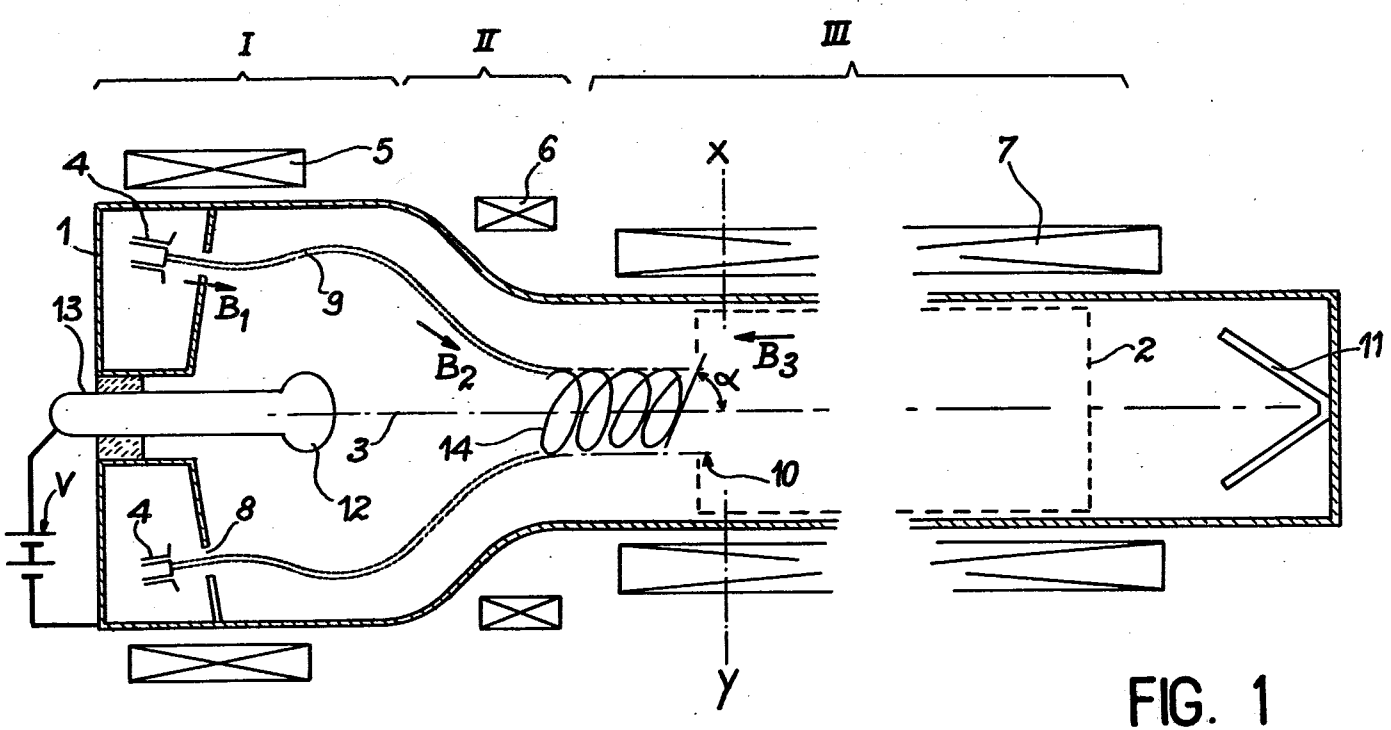
FIG. 1: a diagrammatic sectional view along the injector axis in a first embodiment where the fields $B_1$ and $B_3$ have opposite directions.

FIG. 1 shows in diagrammatic manner the vacuum enclosure 1 associated with an interaction region 2 between an electronic beam and an electromagnetic field containing the resonant structure or cavity. This vacuum enclosure revolves about its axis 3 and diagrammatically has three regions I, II and III in FIG. 1. The extreme regions I and III are cylinders of revolution but of differing diameters, whilst region II is substantially conical and connects regions I and III. In the embodiment of FIG. 1 three coils 5, 6 and 7 serve to create static magnetic fields $B_1$, $B_2$ and $B_3$ in each of the regions I, II and III. Electron gun 4 has an extraction anode 8 which produces an annular electron beam 9, whereby the velocities of the electrons on leaving gun 4 are all concurrent at a same point located on axis 3 when, as is the case in FIG. 1, the beam has a generally convergent conical shape. Magnetic field $B_1$, which generally has a smaller absolute value than field $B_3$ in region III has virtually parallel lines of force at the velocities of the electrons of beam 9 at the time when they leave gun 4. Field $B_3$ in region III is substantially uniform and its lines of force are parallel to injector axis 3. Field $B_3$ acts on tubular beam 10 when it leaves the injector through interaction zone 2 containing the resonant structure or cavity towards target 11 and which causes the cyclotron effect according to which in per se known manner the different electrons of the beam travel through helical orbits about the direction of the magnetic field.

In the intermediate region II the magnetic field varies in amplitude and in direction so as to pass from value $B_1$ in region I to value $B_3$ in region III. In the particular embodiment of FIG. 1 where the fields $B_1$ and $B_3$ are of opposite directions there is therefore a point of region II in which the magnetic field is zero.

The correcting electrode 12 is located in the injector axis 3 and as will be seen hereinafter makes it possible to modify the shape of the trajectories of the electrons. This electrode comprises a metallic conductive mass, whose shape is relatively unimportant provided that it revolves about the axis 3. This electrode 12 is raised to a potential V relative to suction anode 8 of electron gun 4 and its longitudinal position in accordance with axis 3 can be modified at random by translation along an opening 13 made in the wall of vacuum enclosure 1. The potential V to which it is raised is, in most cases, below the acceleration potential of the electron beam by gun 4.

Two fundamentally different constructional embodiments of the injector described hereinbefore with reference to FIG. 1 can be envisaged and will be described successively hereinafter.

The first embodiment of the injector of a tubular beam of monokinetic electrons forming the object of the invention is illustrated in FIG. 1 and relates to the case where the magnetic fields $B_1$ and $B_3$ have their axial component in opposite directions. In this case the trajectories of the different electrons are helices which surround the axis 3 of the injector in an eccentric manner. These various trajectories are diagrammatically indicated at 14 in the outlet zone from the injector and the alpha inclination angle of the helices thus described by the elctrons on axis 3 can reach high values close to 90°, if this is necessary. This alpha angle is regulated by acting on the various parameters of the system consisting of the potential V of the correcting electrode 12, the acceleration voltage of the electron gun 4, the current of the beam and the various absolute and relative values of the magnetic fields $B_1$, $B_2$ and $B_3$.

When the potential V of the correcting electrode 12 is zero, i.e. when the latter is at the same potential as the suction anode 8 of electron gun 4 the cross-section of the tubular electron beam through plane XY perpendicular to injector axis 3 has the configuration shown in FIG. *2a*. The various electron trajectories 14 are then helices of relatively large diameter and thickness e of the annular beam is large. In this configuration each helical trajectory, such as 14, surrounds in an eccentric manner injector axis 3. If, on starting from this initial position, the correcting electrode is generally raised to a potential V, which is normally positive, as indicated in FIG. *2b* a progressive concentration of the annular beam is obtained, whose thickness becomes e' which is substantially below the thickness e of FIG. *2a*. To obtain this result it may also be necessary to simultaneously modify the axial position of electrode 12 on axis 3 in order to empirically arrive at the sought result. In the limiting case a beam is obtained whose cross-section is shown in FIG. *2c* with a maximum concentration, i.e. a beam whose thickness is virtually negligible and whereof all the electrons rotate about the axis 3 of the injector. Experience has shown that the facility of obtaining the optimum correction as shown in FIG. *2c* is partly dependent on the variation of the magnetic field in region II from value $B_1$ to value $B_3$. This regulation becomes proportionally easier if said variation is gradual and in this hypothesis it is easy, by empirically and simultaneously modifying the position and potential of correcting electrode 12, to obtain the minimum thickness of the tubular beam in plane XY prior to the electrons entering interaction zone 2. Thus, it is easily possible to obtain the two main advantages due to the structure of the injector forming the object of the invention, namely on the one hand virtually monokinetic speeds for all the electrons constituting the helical annular beam 14 in region III and on the other a very limited thickness of said helical annular beam.

Figure 3:
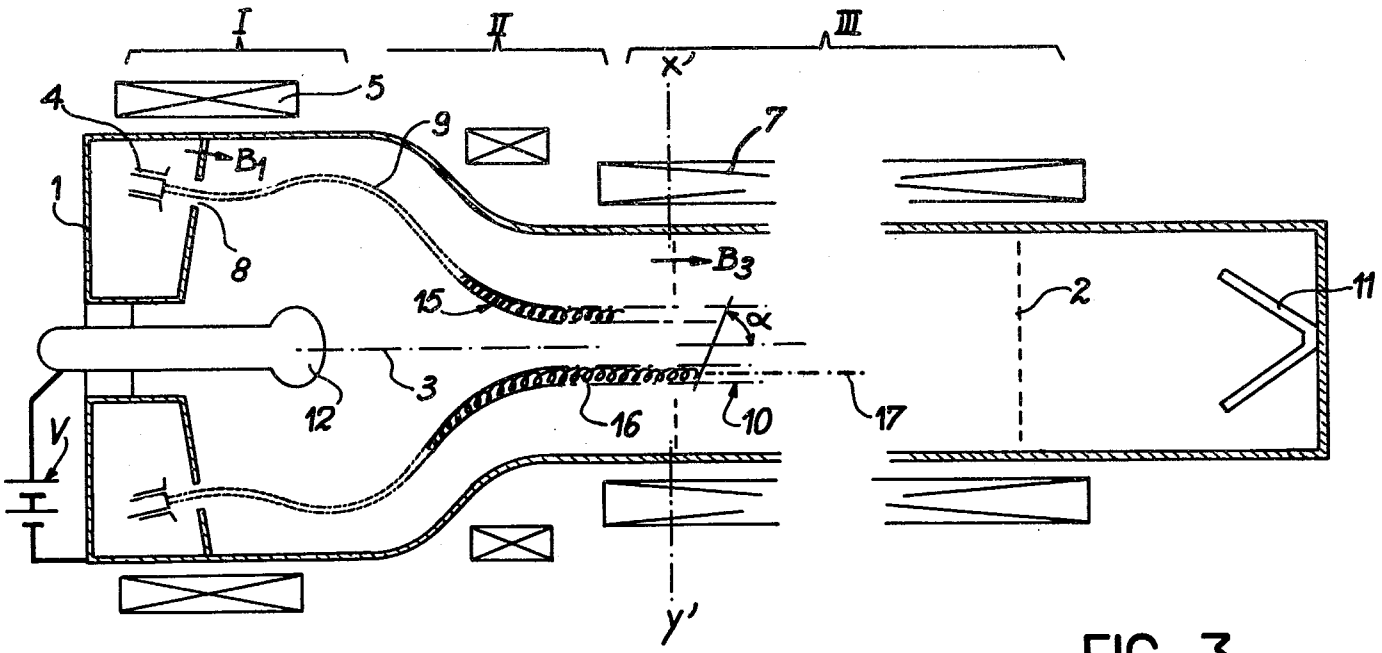
FIG. 3: in section along the axis a diagrammatic view of the injector according to the invention in a second embodiment where the fields $B_1$ and $B_3$ are of the same direction.

A second embodiment of the injector of an annular beam of monokinetic electrons forming the object of the invention is shown in FIG. 3, where the same elements carry the same reference numerals as those in FIG. 1, but where the magnetic fields $B_1$ and $B_3$ have the same direction, at least as regards to their axial component. In this way an annular beam 15 of monokinetic electrons is obtained, whose cross-section through the plane X'Y' perpendicular to axis 3 is shown in FIGS. *4a*, *4b* and *4c* in three possible correction hypotheses using electrode 12. In this embodiment the alpha inclination angle of the helices and trajectories relative to injector axis 3 is essentially dependent on potential V of the correcting electrode 12, as well as on other parameters such as the acceleration voltage of gun 4 and the current of the beam, as well as absolute and relative values of the magnetic fields $B_1$, $B_2$ and $B_3$.

The essential operating difference between this embodiment and the previous embodiment is in the shape of the trajectories which, unlike in FIGS. *2a*, *2b* and *2c* no longer surround the injector axis 3, but are helices 16 whose axes such as 17 are located in the annular zone of the actual beam. When the potential of the correcting electrode 12 is zero the alpha inclination angle of the helices on axis 3 is small and the cross-section of the beam through plane X'Y' has the configuration of FIG. *4a*, i.e. the thickness of the annular beam is relatively small. As the correcting electrode 12 is brought to potentials V which increase progressively and in a generally positive manner relative to the suction anode 8 of gun 4, the alpha inclination angle of the various helices increases towards the limiting value of 90°. Parallel to this the thickness e of the beam increases, which is readily apparent on comparing FIGS. *4a*, *4b* and *4c* corresponding respectively to potentials V increasing from the zero value to a high value, the alpha angle increasing in the same direction.

The thickness e of the thus obtained beam is dependent on numerous factors and in particular the kinetic energy of the beam, field $B_3$ and the alpha inclination angle of the helix, itself dependent on the potential and position of correcting electrode 12 and the space charge due to the presence of other electrons constituting the beam. In the operating mode of FIG. 3 the position and shape of the corrrecting electrode 12 play a by no means negligible part, but it is mainly the potential V to which it is raised which finally determines the alpha inclination angle of the helix which it is desired to obtain prior to the injection of the beam into interaction zone 2 containing the electromagnetic cavity or structure.

The invention is not limited to the embodiments described and represented hereinbefore and various modifications are possible thereto without passing beyond the scope of the invention.

What is claimed is:

1. An injector for an annular beam of monokinetic electrons in helical orbits having a high inclination angle relative to the axis of the helix of the type having an annular electron gun in a revolving vacuum enclosure, wherein it also comprises electrical coils which are able to create the cyclotron effect by a static magnetic field varying in progressive manner in accordance with the axis of the injector from a value $B_1$ in the actual gun zone up to a value $B_3$ in the contracted outlet zone of the injector passing through an intermediate value $B_2$ in the convergent connection zone between said gun zone and said outlet zone, and a correcting electrode located so as to be movable in accordance with the axis of the injector and which is raised to an electrical potential differing from that of the suction or extraction anode of said electron gun.

2. An injector according to claim 1, wherein the correcting electrode is placed within the annular beam.

3. An injector according to claim 1, wherein the correcting electrode is located on the injector axis close to the area of the gun.

4. An injector according to claim 1, wherein the correcting electrode revolves about said gun area.

5. An injector according to claim 4, wherein the correcting electrode is a conductive mass having a substantially ovoid shape.

6. An injector according to claim 1, wherein the axial components of the magnetic fields $B_1$ and $B_3$ are in the same direction, each electron describing a helix whose axis is located in the annular zone covered by the beam.

7. An injector according to claim 1, wherein the axial components of the magnetic fields $B_1$ and $B_3$ have opposite directions, each electron describing a helix which in eccentric manner surrounds the injector axis.

8. An injector according to claim 4, wherein the potential of the correcting electrode, as well as its position are chosen so that the thickness of the helical annular beam is minimal and each electron describes a helix whose axis essentially coincides with the injector axis.

* * * * *